United States Patent [19]

Kusko

[11] Patent Number: 4,615,484

[45] Date of Patent: Oct. 7, 1986

[54] INSULATIVE PROTECTIVE DEVICE FOR RAIL FASTENER

[75] Inventor: Alexander Kusko, Weston, Mass.

[73] Assignee: San Francisco Bay Area Rapid Transit District, Oakland, Calif.

[21] Appl. No.: 735,539

[22] Filed: May 20, 1985

[51] Int. Cl.[4] ..... E01B 9/38; E01B 11/54

[52] U.S. Cl. ..... 238/264; 238/154; 238/310

[58] Field of Search ..... 238/154, 338, 312, 310, 238/155–161, 152, 209, 210–212, 107, 283, 264; 174/138 R, 138 D

[56] References Cited

U.S. PATENT DOCUMENTS 3,784,097 1/1974 Landis ..... 238/310

3,858,804 1/1975 Hixson ..... 238/238 X

FOREIGN PATENT DOCUMENTS 2421092 11/1974 Fed. Rep. of Germany .

*Primary Examiner*—Randolph A. Reese

*Assistant Examiner*—Glenn B. Foster

*Attorney, Agent, or Firm*—Owen, Wickersham & Erickson

[57] ABSTRACT

A rail-support insulating device for electrically insulating a rapid transit rail and rail fastener from the rail support structure is described. The device includes an electrically non-conductive member that surrounds and extends outwardly from the rail fastener and over its support structure. Also a pair of planar disc members of similar material extend around and outwardly from the heads of the mounting bolts for the rail fastener, thereby forming long surface electrical creepage paths between the rail and the rail support that provide electrical isolation even when the entire assembly of rail fastener and rail support is wet with electrolyte.

8 Claims, 4 Drawing Figures

INSULATIVE PROTECTIVE DEVICE FOR RAIL FASTENER

BACKGROUND OF THE INVENTION

This invention relates to rail fastening devices for railway systems, and more particularly it relates to a protective device for electrically insulating a rail fastener from its supporting structure.

Tracks or rails for modern rapid transit rail systems are generally fastened to a supporting structure by means of a plurality of spaced apart rail fasteners. Examples of such rail fasteners that have been used are described in U.S. Pat. Nos. 3,784,097 to Landis and 3,858,804 to Hixson. Both of these assemblies comprise a metal top plate which is fastened to the rail and a base plate separated from the top plate by a layer of elastomeric, a material to provide vibration isolation and a degree of electrical insulation, with the entire assembly being fastened to supporting structure such as a concrete bed.

Because rapid transit rails are used as electrical conductors for traction power current as well as for train speed command signals, it is necessary to provide and maintain electrical insulation between the rails and the rail support structure. The aforesaid rail fasteners presently in use do provide some electrical insulation between the rails and the rail support structure. However, heretofore, the surface creepage paths provided by the insulating elements of existing apparatus were found to be relatively short and easily contaminated with dirt and rail wear products. When these contaminated surfaces then became wet by fog, rain, or ground water, electrically conductive paths were formed over which electrical leakage currents flowed. Such leakage currents caused corrosion of the rail as well as of the metal parts of the rail fasteners and supports, resulting in further contamination of the surface creepage paths. This additional contamination of the creepage paths resulted in further reduction of the electrical resistance of the creepage paths and thence in larger magnitudes of leakage currents.

Such excessive leakage currents from train operation over poorly insulated rails caused destructive corrosion of rail, rail fasteners, rail support structures, metal tunnel liners, and other metallic structures. An excessively low rail-to-rail support structure resistance caused by such corrosion also tended to short out train speed command signals between the rails. In such a situation, the shorted section of track then appeared to the train speed command system as though it were occupied by a train, and train operation was disrupted.

To prevent loss of electrical train speed command signals and leakage of electrical traction currents over creepage paths, rail circuit insulation integrity must be maintained, and the rail fastener or support insulation must provide electrical insulation even when wet and contaminated with electrolyte. Therefore, the rail must be insulated from the rail fastener or support with electrical insulation means which provides relatively long surface creepage paths. Such long creepage paths will maximize the electrical leakage path resistance between rail and rail support even when the rail and the rail fastener or support apparatus are wet and contaminated with electrolyte.

In addition, the rail support insulating device must not interfere with the rail fastener's ability to securely fasten the rail relative to the support structure and to limit relative movement of the rail to within acceptable tolerances in the vertical, lateral, and longitudinal directions.

Accordingly, a general object of the present invention is to provide a rail insulating device that solves the aforesaid problems by electrically insulating rapid transit rails from their support structures.

Another object of the invention is to provide a device that reduces the flow of leakage current on a rail fastener for a rapid transit rail system, thereby greatly reducing corrosion and deterioration of the fastener and the rail.

Another object of the present invention is to provide a rail insulating device for electrically insulating rapid transit rails from their support structures that provides long surface electrical creepage paths for leakage current so that the device will maintain its electrical insulating properties when wet and contaminated with electrolyte.

Still another object of the present invention is to provide a rail insulating device that can be applied to any type of rail fastening method that clamps the rail in such a way that neither the rail hold-down assembly nor the rail lateral restraint device will make point contact against or penetrate the device.

Yet another object of the present invention is to provide a device for reducing the leakage current and thus the corrosion rate on a rail fastener which is relatively easy and economical to install on an existing rail fastener without requiring its modification or removal.

BRIEF SUMMARY OF THE INVENTION

In accordance with the invention, an insulation device for preventing the flow of leakage current is provided for use with rail fasteners such as the aforesaid Landis and Hixson fasteners which are adapted to secure the track rails to a concrete structure. The insulation device comprises a skirt of electrically non-conductive material, such as plastic or rubber, which surrounds the fastener. This skirt is attached to the edge of the fastener assembly and extends outwardly and slightly downward from it at a slight angle. Thus, the skirt extends from the fastener and terminates at a substantial distance above the surface of the surrounding support structure. In addition, circular discs and washers of electrically non-conductive material are placed around the two mounting bolts for the fastener whose heads extend above its upper surface. Each fastener has a pair of slots to accommodate nuts and bolts for clip members that secure the rail to the fasteners. As a further means to block potential leakage current paths, a pair of secondary electrically non-conductive sheet members are located near the aforesaid slots at the bottom of the fastener. Together the aforesaid non-conductive components insulate the fastener and prevent the "creep" of leakage current from the rail over and through the fastener and thus the corrosion which was heretofore prevalent.

Other objects advantages and features of the invention will become apparent from the following detailed description of one embodiment thereof, presented in conjunction with the accompanying drawing.

DETAILED DESCRIPTION OF EMBODIMENT

Figure 1:
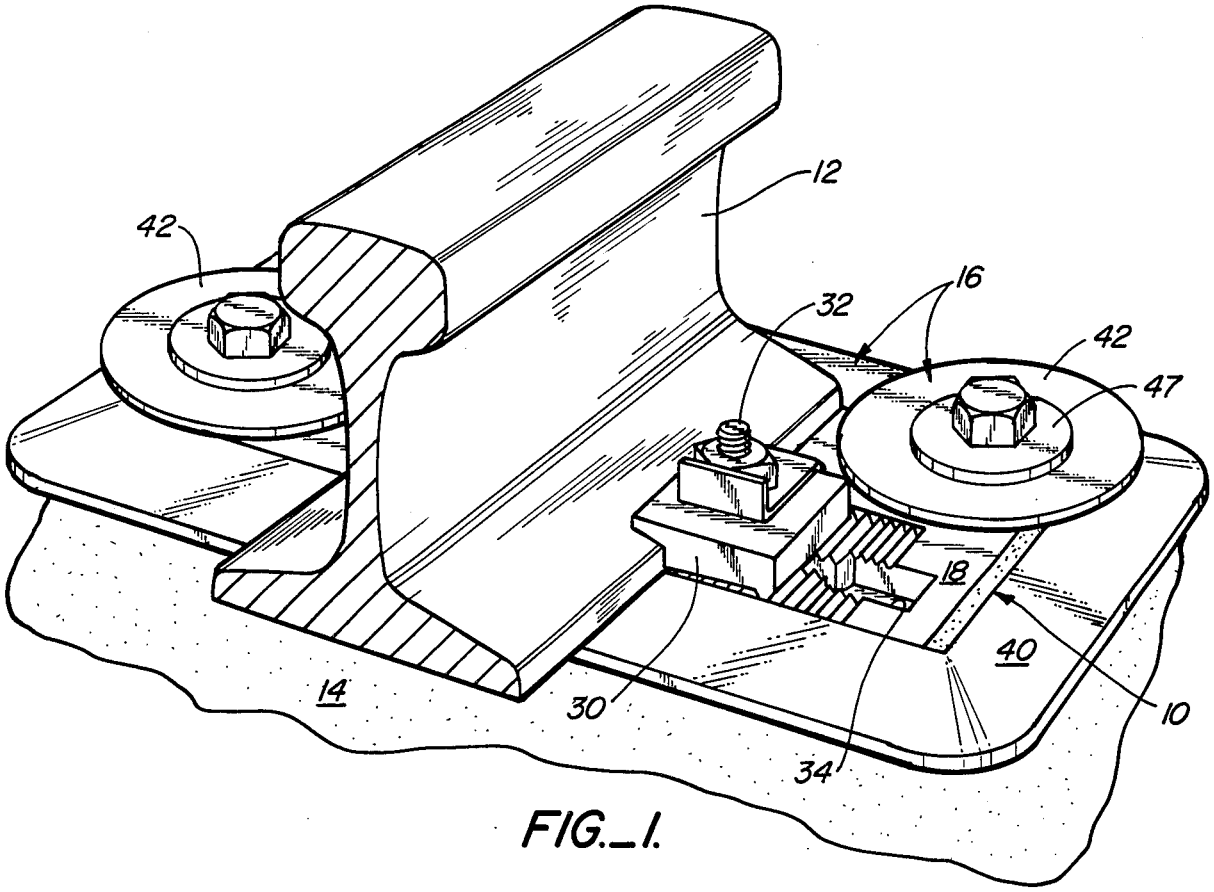
FIG. 1 is a view in perspective of a rail fastener installed with an insulation protective device according to the present invention.
Figure 4:
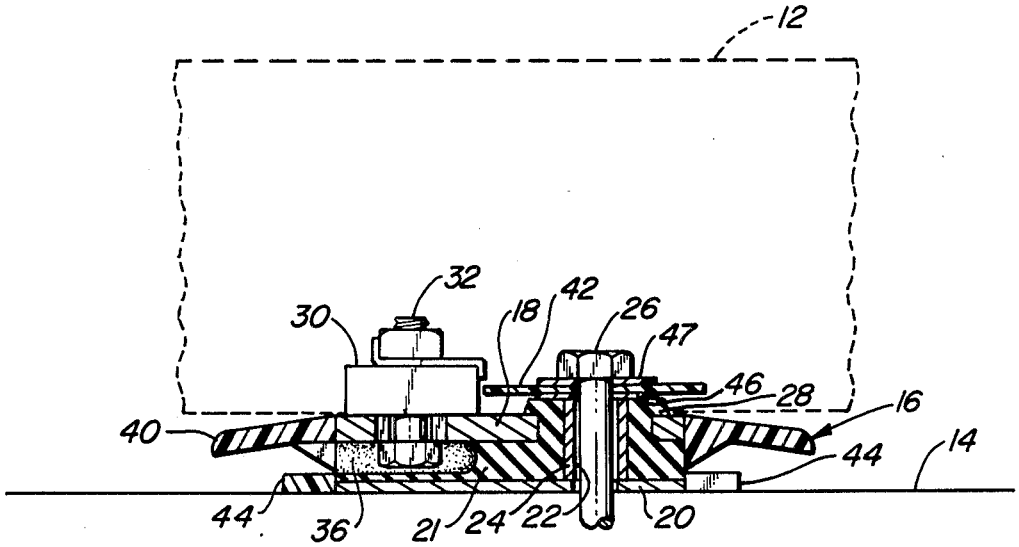
FIG. 4 is a view in section taken along line 4—4 of FIG. 2.

With reference to the drawing, FIG. 1 shows a typical rail fastener 10 as it appears when installed for directly affixing a rail 12 to a planar support structure 14 and having a protective insulation device 16 according to the present invention. Although the device 16 could be used on different forms of rail fasteners, for purposes of illustration, it is shown installed on a "Landis" type rail fastener which is described in U.S. Pat. No. 3,576,293. In general, this rail fastener, as shown in the drawing FIGS. 1–4, comprises a rigid first or upper plate 18 and a base plate 20 separated by a layer 21 of elastomeric material. A pair of circular holes 22 extend through sleeves 24 within the fastener to accommodate bolts 26 that serve to secure the fastener to the supporting structure 14. These bolts are threaded into inserts (not shown) embedded in the concrete supporting structure. The head end of each bolt projects above an elastomeric or non-conductive boss portion 28 that protrudes above its hole 22 on the upper side of the fastener.

A pair of clips 30 are each attached by a bolt 32*a* and a nut 32*b* to the upper plate 18 and serve to connect the fastener to the lower flanges of the rail. The lower end of the bolt extends below the upper plate through a slot 34 therein and into an aligned, enlarged cavity 36 formed within the rubber layer. The slot allows the clip and its bolt to be moved and adjusted into engagement with the rail flange before the bolt 32*a* and nut 32*b* are tightened.

Figure 2:
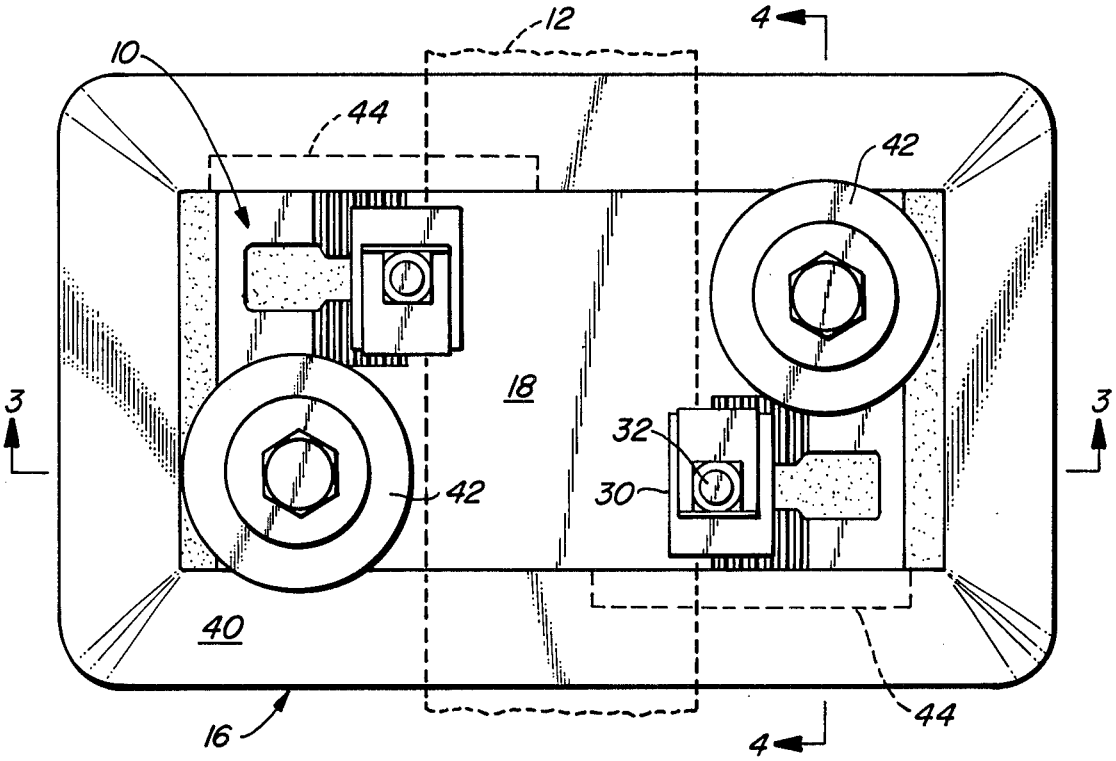
FIG. 2 is a plan view of the rail fastener and insulation device of FIG. 1.
Figure 3:
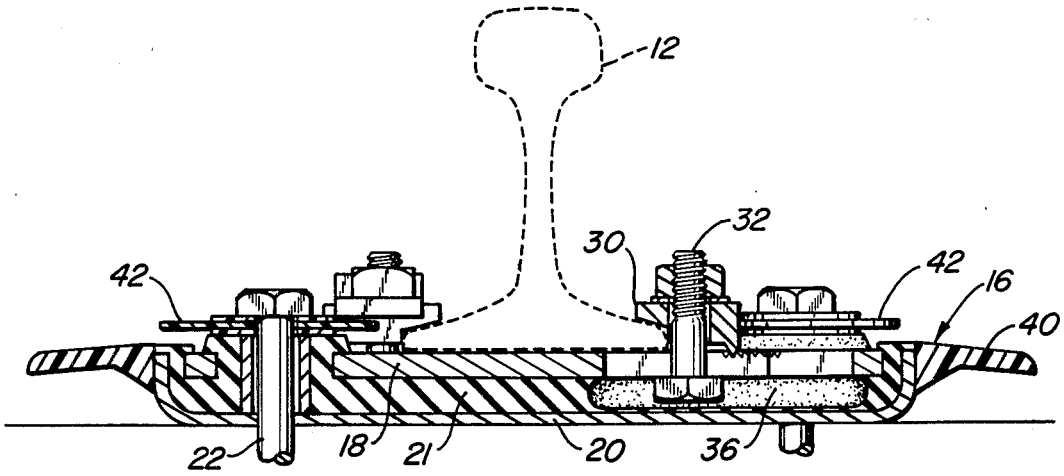
FIG. 3 is a view in section taken along line 3—3 of FIG. 2.

The protective insulation device 16 for the rail fastener 10, as shown in FIGS. 1 and 2, comprises a first component consisting of a top skirt 40 that extends around the periphery of the fastener, a pair of second components consisting of disc members 42 around the heads of the bolts 26, and third components consisting of a pair of lower skirt members 44 each adjacent to a slot opening 48 in the side to the cavities for the clip bolts 32.

The top skirt 40 has a rectangular shape and is made of a suitable electrically non-conductive material such as polyethylene. The cross-section may be tapered or uniform, as necessary for the skirt to maintain its shape, and to be fastened to a base plate 20. The thickness at the extremity is about 0.15 inches. The width of this skirt is uniform (e.g. 3.25 inches) and it slopes outwardly and preferably slightly downwardly at a small angle with the horizontal (e.g. 18°) from the edge of the rail fastener assembly. The inner dimensions of the skirt 40 are such that it fits snugly against the top edge of the fastener and it is adhered thereto by means of a suitable adhesive material, such that no leakage can occur through the joint.

The disc members 42 are each used in combination with a washer 46 having a smaller outer diameter which is sized to fit around the upper end of a mounting bolt 26 below the disc member and in contact with a rubber boss portion 28 on the fastener. Each disc member is concentric with and adjacent to its washer 46, and both are also made of an electrically non-conductive material such as polyethylene. A standard metal washer 47 is used on the upper side of each disc member as a retaining means. Also, each disc member has a larger outside diameter (e.g. 2.75 inches), so that the disc members extend radially outwardly for a substantial distance from the bolts 26.

The third components or lower skirt members 44 are comprised of electrically non-conductive sheet pieces, preferably of the same material and having the same thickness as the upper skirt 40. Each lower skirt member is attached by an adhesive material to an end wall of the fastener just below an opening 48 in the elastomeric layer 21 between the fastener plates 18 and 20. Thus the lower skirt members 44 extend outwardly from opposite end walls of the fastener and are essentially flush with the supporting structure to which the fastener is attached.

When the various components of the protective insulation device are installed on a rail fastener such as the one illustrated, relatively long surface creepage paths are created so that the flow of leakage current through the fastener is greatly reduce or essentially entirely limited. The upper skirt 40 effectively blocks the flow of and leakage current from the rail that may travel across the fastener to its periphery and attempt to travel down its sides. Similarly the disc members 42 and their washers provide a means that provides extensive creepage paths that essentially block the travel of any leakage current from the bolts 26 across the fastener. Finally, the lower skirt members 44 greatly reduce the possibility of any leakage current finding a conductive creepage path through the slots 34 and their respective cavities 36 between the fastener plates. In combination, the electrically non-conductive components of the protective insulation device 26 greatly reduce, if not totally eliminate the flow of leakage current from an attached rail over or through a fastener which could otherwise cause serious corrosion and damage to the fastener.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. In a rail fastener for fastening a rail means to a supporting structure and having rigid plate means with a generally rectangular shape, means for securing said fastener to said supporting structure including a pair of spaced apart holes through said plate means and mounting bolts extending through said holes with head portions at their upper ends, and an insulation means within said rail fastener to prevent the flow of electricity through said rail fastener, the improvement consisting of an insulation protective device to further prevent the flow of leakage current from said rail means, said device comprising:

a continuous, semi-rigid skirt member of electrically non-conductive material attached to and extending outwardly away from the sides of said fastener said skirt member having an upper surface, said upper and lower surfaces having a lower underside surface and being free from contact with any surrounding supporting structure, thereby increasing the length of possible current leakage paths from said rail means to said surrounding supporting structure having ground potential; and a pair of planar disc members of electrically non-conductive material extending around and outwardly from each of said mounting bolts adjacent to their head ends.

2. The protective device of claim 1 wherein said skirt member is attached to the top edges of the four sides of said rectangular fastener and slopes downwardly and outwardly from each said top edge.

3. The protective device of claim 2 wherein said skirt member has a uniform width around the said fastener of around 3.25 inches.

4. The protective device of claim 2 wherein said skirt member is made of a plastic material having a uniform thickness of around 0.15 inches.

5. The protective device of claim 2 wherein said shirt member tapers outwardly in cross-section to a minimum thickness at its outer edge.

6. The protective device of claim 1 wherein said planar disc members are made of a plastic material having a circular shape with a diameter of around 2.75 inches.

7. The protective device of claim 5, including a circular electrically non-conductive washer member for each disc member having a diameter less than said disc members and located concentrically below each disc member around a said mounting bolt.

8. The protective device of claim 1 and including secondary skirt members attached to and extending from opposite sides of said fastener near the lower edges thereof so as to lie adjacent to said supporting structure.

* * * * *